US005331333A

United States Patent [19]

Tagawa et al.

[11] Patent Number: 5,331,333

[45] Date of Patent: Jul. 19, 1994

[54] DISPLAY APPARATUS

[75] Inventors: Takao Tagawa, Kashihara; Hitoshi Nohno, Osaka, both of Japan

[73] Assignee: Sharp Kabushiki Kaisha, Osaka, Japan

[21] Appl. No.: 966,116

[22] Filed: Oct. 23, 1992

Related U.S. Application Data

[63] Continuation of Ser. No. 773,975, Oct. 8, 1991, abandoned, which is a continuation of Ser. No. 437,902, Nov. 16, 1989, abandoned.

[30] Foreign Application Priority Data

Dec. 8, 1988 [JP] Japan ..... 63-310447
Jan. 31, 1989 [JP] Japan ..... 1-23553

[51] Int. Cl.[5] ..... G09G 3/02

[52] U.S. Cl. ..... 345/7; 345/126; 345/31; 359/632

[58] Field of Search ..... 340/705, 980, 727; 350/174, 3.7; 345/7, 8, 9, 126, 31; 359/13, 630, 631, 632, 633

[56] References Cited

U.S. PATENT DOCUMENTS 3,170,979 2/1965 Baldwin ..... 340/705
4,129,982 12/1978 de la Cruz ..... 250/61.47
4,368,950 1/1983 Sakamoto ..... 350/174
4,447,128 5/1984 Ferrer ..... 350/3.7
4,527,155 7/1985 Yamaki et al. ..... 340/727
4,542,377 9/1985 Hagen et al. ..... 340/727
4,564,291 1/1986 Yoshino et al. ..... 356/125
4,736,442 4/1988 Kornfeld ..... 340/727
4,823,080 4/1989 Lin ..... 340/727
4,831,368 5/1989 Masimo et al. ..... 340/723
4,876,488 10/1989 Gentile ..... 340/727

*Primary Examiner*—Ulysses Weldon
*Assistant Examiner*—Matthew Luu
*Attorney, Agent, or Firm*—Merchant, Gould, Smith, Edell, Welter & Schmidt

[57] ABSTRACT

A display apparatus in which light outputted from an LED array arranged in a column is reflected by a vibrating mirror such that a two-dimensional image is obtained, comprising: a half mirror which reflects light having a wavelength identical with a light emitting wavelength of the LED array and transmits therethrough visible light having other wavelengths than the light emitting wavelength; the half mirror being so disposed as to not only transmit therethrough the visible light from outside but also reflect the light proceeding from the LED array via the vibrating mirror such that the two-dimensional image has an outer scene as its background.

6 Claims, 10 Drawing Sheets

DISPLAY APPARATUS

This is a continuation of application Ser. No. 07/773,975 filed Oct. 8, 1991, which is a continuation of prior application Ser. No. 07/437,902 filed Nov. 16, 1989 both now abandoned.

BACKGROUND OF THE INVENTION

The present invention relates to a display apparatus suitable for operating a computer or various electronic appliances such that an operator can operate the computer or the electronic appliances while viewing display of the display apparatus.

FIG. 1 shows one example of a display unit 60 of a known display apparatus disclosed in Japanese Application No. 63-93845 filed Apr. 15, 1988. As taught in that application, and as further taught in Japanese Patent Application No. 63-108778, filed Apr. 30, 1988, an operator puts on the known display apparatus as shown in FIG. 2. In FIG. 1, an LED array 61 acting as a light source is provided at a lower portion of a casing 62. The LED array 61 is formed by a one-dimensional high-density monolithic array of, for example, 32 dots/mm or so. In FIG. 1, only one element of the LED array 61 is shown but actually, a plurality of the elements are arranged in series in the direction perpendicular to the sheet of FIG. 1. Supposing that the LED array 61 has a length of, for example, about 8.4 mm, a total of the elements are constituted by 280 dots. In order to obtain a two-dimensional image of the light source, a vibrating mirror 63 is provided so as to confront the light source. A resonance type scanner 64 is provided for vibrating the vibrating mirror 63 at high speed. When the LED array 61 is flickered in response to a data signal synchronously with vibrations of the vibrating mirror 63, a planar image is reflected in the vibrating mirror 63 as a virtual image. Thus, signals for one picture are transmitted during one period of vibrations of the vibrating mirror 63. The LED array 61 is provided at a focal point of a lens 65. Light from the LED array 61 is reflected by the vibrating mirror 63 and is changed into parallel light by the lens 65 such that the parallel light reaches an eye 66 of the operator. In this case, the lens 65 may also be provided between the LED array 61 and the vibrating mirror 63.

As shown in FIG. 2, the display unit 60 is attached to one end of a frame 70 and the other end of the frame 70 is mounted on a head set 72 through a rotary support member 71. The display unit 60 is rotated about the rotary support member 71 in a lateral direction so as to be changed over to an observational position and a nonobservational position. Meanwhile, a lead wire 73 is attached to a garment of the operator by a clip 74 so as not to disturb operation of the computer or the electronic appliances and is connected to a host portion (not shown) placed at another location. The operator puts the head set 72 on his head and positions the display unit 60 in front of an eye of the operator so as to view an image displayed by the display unit 60.

Meanwhile, in the known display apparatus referred to above, such a problem arises that since the display unit 60 obstructs the operator from viewing a subject or a scene in front of the display unit 60, it is difficult for the operator to manipulate switches, etc. in front of the display unit 60 while viewing an image displayed by the display unit 60. Furthermore, the display known apparatus has such a drawback that since an image, for example, a red image is displayed in the black background in the display unit 60, the eye of the operator is readily fatigued.

As shown in FIG. 3, a display window 68 is provided at either one of right and left sides of the display unit 60 such that the operator can view the background, e.g. a keyboard of the computer with one of his eyes while viewing a screen of the display unit 60 with the other one of his eyes. FIG. 3 shows a case in which the operator views the background with his right eye while viewing the screen of the display unit 60 with his left eye. In the case where the operator views the background with his left eye while viewing the screen of the display unit 60 with his right eye by using the display unit 60, the display unit 60 may be turned upside down as shown in FIG. 4. However, when the display unit 60 has been turned upside down, a picture on the screen of the display unit 60 is also seen upside down if no measures are not taken. Thus, a changeover switch 69 for changing over vertical orientation of the picture is provided. If the displayed picture is seen upside down, vertical orientation of the picture is changed over by operating the changeover switch 69.

Meanwhile, image signals corresponding to one page of the screen of the display unit 60 are stored in a data storage formed by, for example, a DRAM (dynamic random access memory) provided at the host portion so as to be transferred to the LED array 61 through the lead wire 73. However, in the case where vertical orientation of the picture of the display unit 60 has been changed over by operating the changeover switch 69, picture elements to be transferred are transmitted by converting sequence of transfer of the picture elements.

However, the methods disclosed in Japanese Patent Applications 63-93845 and 63-108778 have an inconvenience in that the circuit configuration used becomes complicated for the following reason. The LED array 61 is usually provided in a zigzag shape so as to increase density of the picture elements such that one column of the LED array 61 are turned on several rows later than the other column of the LED array 61. FIG. 5 shows prior art LED drivers 81 and 82 for driving the LED array 61. In the LED array 61, one column of 100 LEDs 1D to 100D of 100 dots and the other column of 100 LEDs 1E to 100E of 100 dots are staggered so as to have 200 dots. The two columns are spaced a distance corresponding to three rows from each other. By wire bonding, the LED array 61 is connected to the LED drivers 81 and 82 including a shift register and a latch. Characters Dd and De denote image signals and the arrow X represents a scanning direction based on vibrations of the mirror.

If an image of one column formed by the image signals Dd and De is displayed on a straight line by an array of 200 dots, namely, 1D, 1E, 2D, 2E,—99D, 99E, 100D and 100E, the LEDs 1D to 100D are required to be turned on later than the LEDs 1E to 100E by a duration corresponding to three rows. Thus, although there is time difference between turning on of the two columns of the LEDs, the turned on images are seen as being arranged in a column of the LEDs 1D, 1E, 2D, 2E,—99D, 99E, 100D and 100E by effect of afterimage. Characters SR1, SR2, SR3 and SR4 denote 100-bit shift registers for making the above mentioned time difference of three rows. The shift registers SR2 and SR3 are not used for making the time difference but are used for changing sequence of array so as to prevent formation of reverse array caused by the fact that the LED drivers 81 and 82 are constituted by an identical element. If a bidirectional shift register having up/down function is employed as a shift register SR0 of the LED drivers 81 and 82, the shift registers SR2 and SR3 can be deleted.

In the above described circuit configuration, it will be readily seen that if correspondence between a bit map of display and a bit map of memory is obtained, it is difficult that changeover of vertical orientation of the displayed image through change of sequence of the image signals Dd and De is performed by merely converting sequence of transfer of the picture elements from the data storage.

Therefore, the known display apparatus described in the two applications above has been disadvantageous in that the circuit configuration becomes complicated in order to change over vertical orientation of the picture in response to changeover of vertical orientation of the display apparatus.

SUMMARY OF THE INVENTION

Accordingly, an essential object of the present invention is to provide a display apparatus in which both a displayed image and a subject or an image in front of a display unit can be viewed simultaneously by an identical eye and the displayed image can be viewed in a bright background.

Another important object of the present invention is to provide a display apparatus in which vertical orientation of a picture of the display unit can be changed over by a simple circuit.

In order to accomplish the first object of the present invention, there is provided a display apparatus according to a first embodiment of the present invention in which light outputted from an LED array arranged in a column is reflected by a vibrating mirror such that a two-dimensional image is obtained, the improvement comprising: a half mirror which reflects light having wavelengths which include the light emitting wavelength of said LED array and transmits therethrough visible light having other wavelengths; said half mirror being so disposed as to not only transmit therethrough the visible light from outside but also reflect the light proceeding from said LED array via said vibrating mirror such that the two-dimensional image has an outer scene as its background.

In the display apparatus according to the first embodiment of the present invention, the half mirror reflects light outputted from the LED array and reflected by the vibrating mirror and transmits therethrough, from among external visible light, visible light having other wavelengths. Therefore, since an image formed by light having the light emitting wavelength of the LED array, for example, red light can be viewed in the background formed by the outer scene having the light of the light emitting wavelength removed therefrom, for example a bluish scene from which red color has been removed, the operator can operate switches, etc. in front of the display unit while viewing the displayed image and fatigue of eyes of the operator is lessened.

Meanwhile, in order to accomplish the second object of the present invention, there is provided a display apparatus according to a second embodiment of the present invention in which light outputted from an LED array arranged in a column is reflected by a vibrating mirror driven in a sinusoidal wave such that a two-dimensional image is obtained, the improvement comprising: a first means for indicating whether said display apparatus is oriented upwardly or downwardly; and a second means for driving said LED array, which, in response to a signal from said first means indicative of whether said display apparatus is oriented upwardly or downwardly, not only turns on said LED array at a rise region or a fall region of the sinusoidal wave but also sets sequence of turning on of said LED array in a forward direction or in a reverse direction.

In the above described arrangement of the display apparatus according to the second embodiment Of the present invention, if vertical orientation of the display apparatus is reversed, the drive means, in response to the signal from the vertical orientation indicating means indicative of this reversal, not only changes timing of turning on of the LED array from one of the rise region and the fall region of the sinusoidal wave to the other one of the rise region and the fall region of the sinusoidal wave but also changes sequence of turning on of the LED array.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
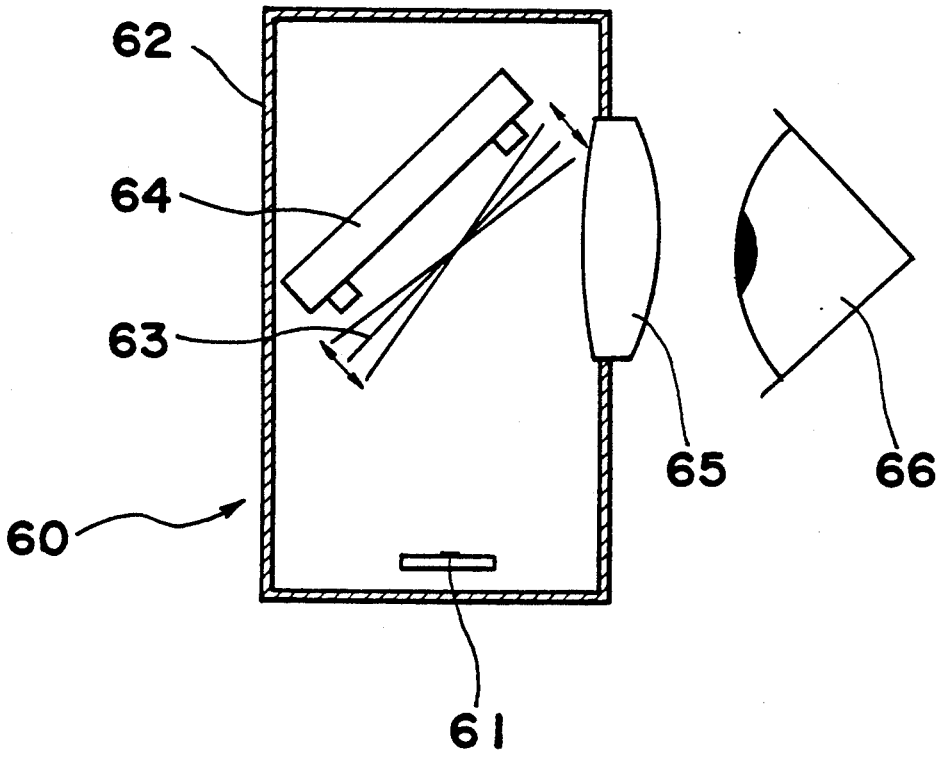
Fig. 1 PRIOR ART
FIG. 1 is a schematic sectional view of a display unit of a prior art display apparatus (already referred to)
Figure 6:
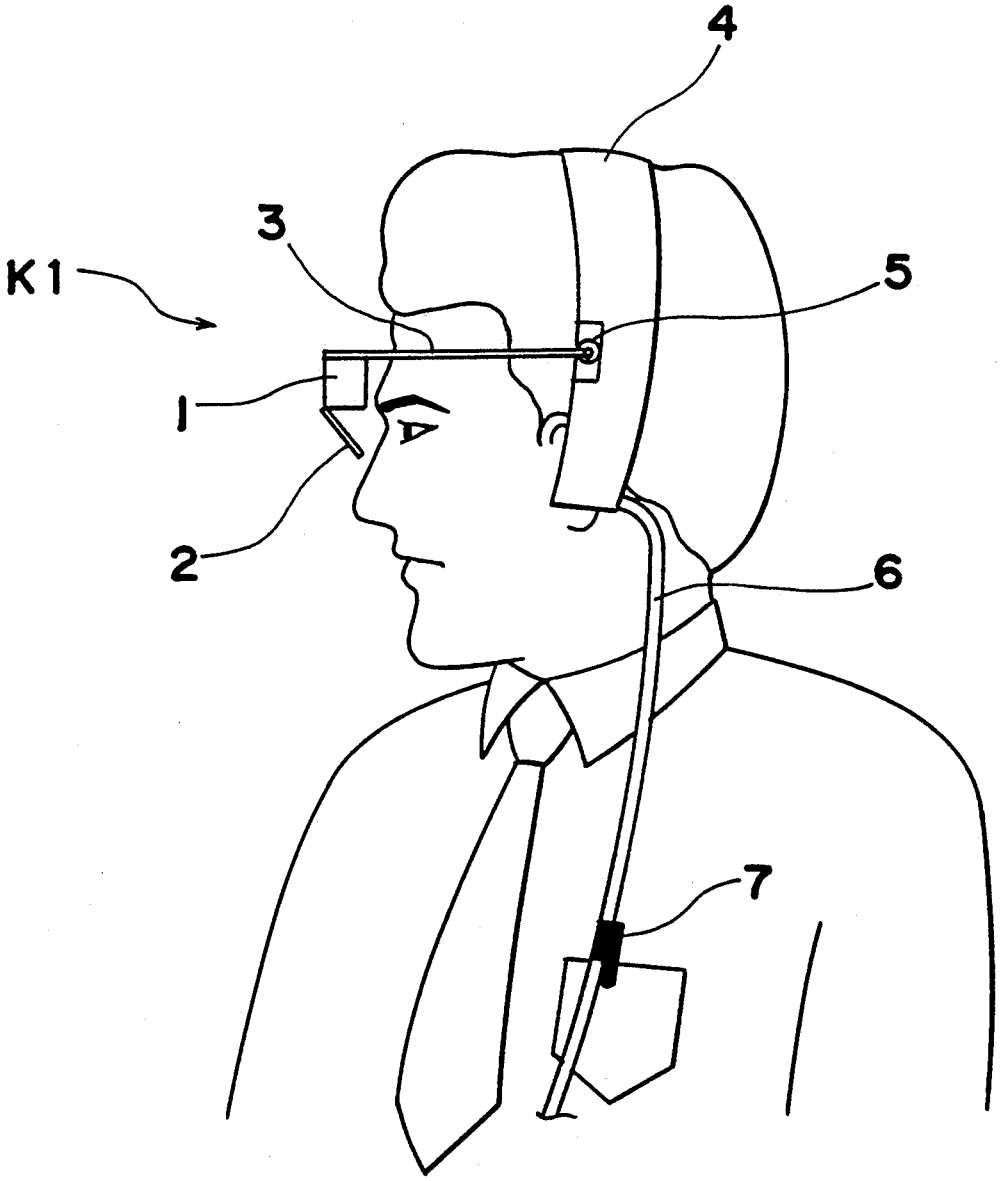
FIG. 6 is a view showing that an operator puts on a display apparatus according to a first embodiment of the present invention.

Referring now to the drawings, there is shown in FIG. 6, a display apparatus K1 suitable for operating a computer or various electronic appliances, according to a first embodiment of the present invention. In FIG. 6, an operator puts on the display apparatus K1. The display apparatus K1 includes a display unit 1 having an arrangement identical with that of the prior art display unit 60 of FIG. 1, a frame 3, a head set 4, a rotary support member 5, a lead wire 6 and a clip 7. The display unit 1 is attached to one end of the frame 3 such that an outlet of light of the display unit 1 is oriented downwardly. A half mirror 2 is mounted on a lower end portion of the display unit 1 at an angle of about 45° to the display unit 1. Light emitted from the display unit 1 is reflected by the half mirror 2 so as to proceed to an eye of the operator. The other end of the frame 3 is mounted on the head set 4 through the rotary support member 5. The display unit 1 is rotated about the rotary support member 5 in a lateral direction so as to be changed over to an observational position and a nonobservational position. The lead wire 6 is fixed to a garment of the operator so as not to disturb operation of the computer or the electronic appliances and is connected to a host portion (not shown) placed at another location. The operator puts the head set 4 on his head and positions the display unit 1 in front of an eye of the operator so as to view an image displayed by the display unit 1.

Figure 7:
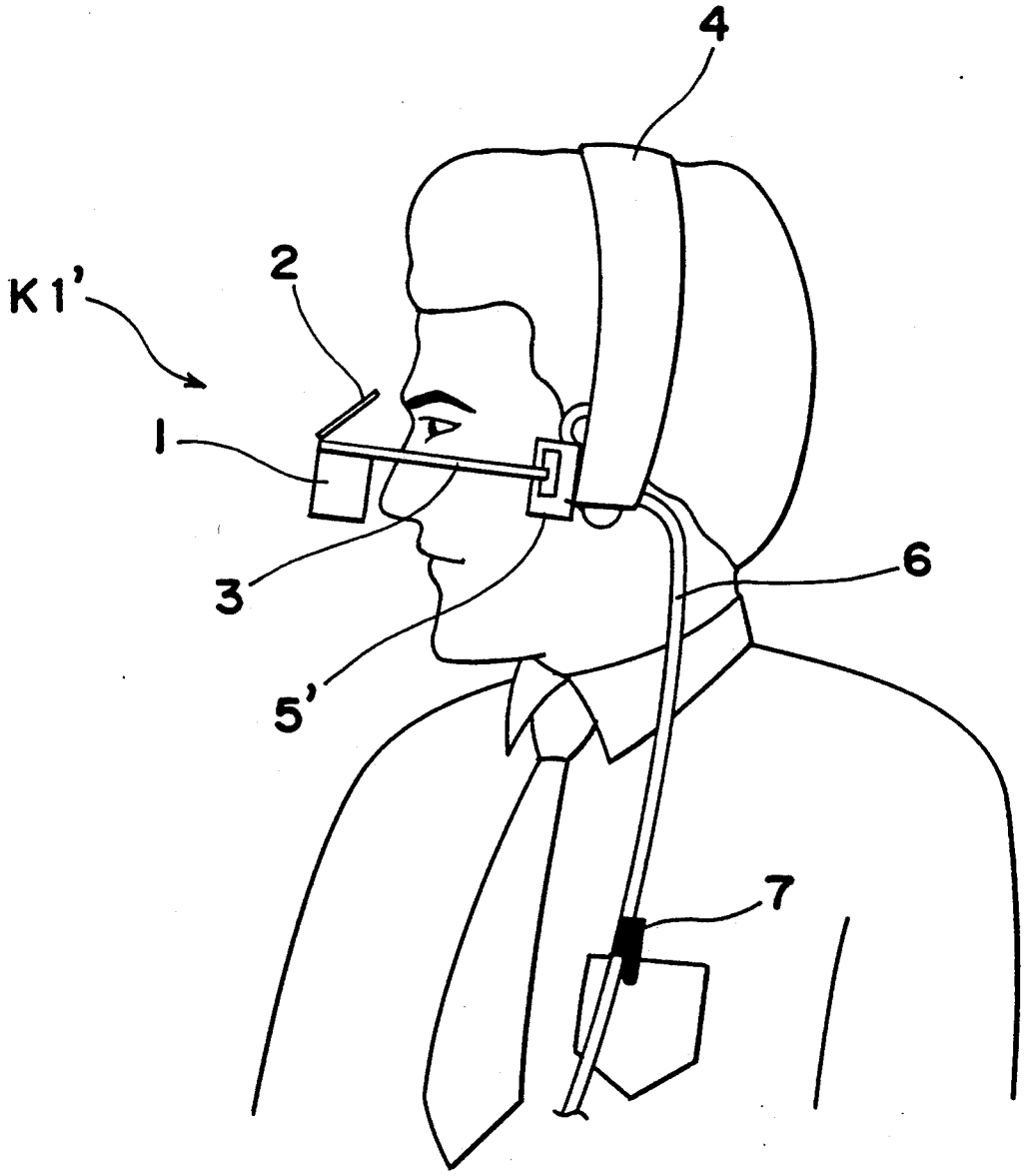
FIG. 7 is a view similar to FIG. 6, particularly showing a modification thereof.

Referring to FIG. 7, there is shown a display apparatus K1' which is a modification of the display apparatus K1. In the display unit K1', the display unit 1 is attached to the frame 3 such that the outlet of light of the display unit 1 is oriented upwardly. Thus, the half mirror 2 is mounted on an upper end portion of the display unit 1. Since other constructions of the display apparatus K' are the same as those of the display apparatus K1, description thereof is abbreviated for the sake of brevity.

Figure 8:
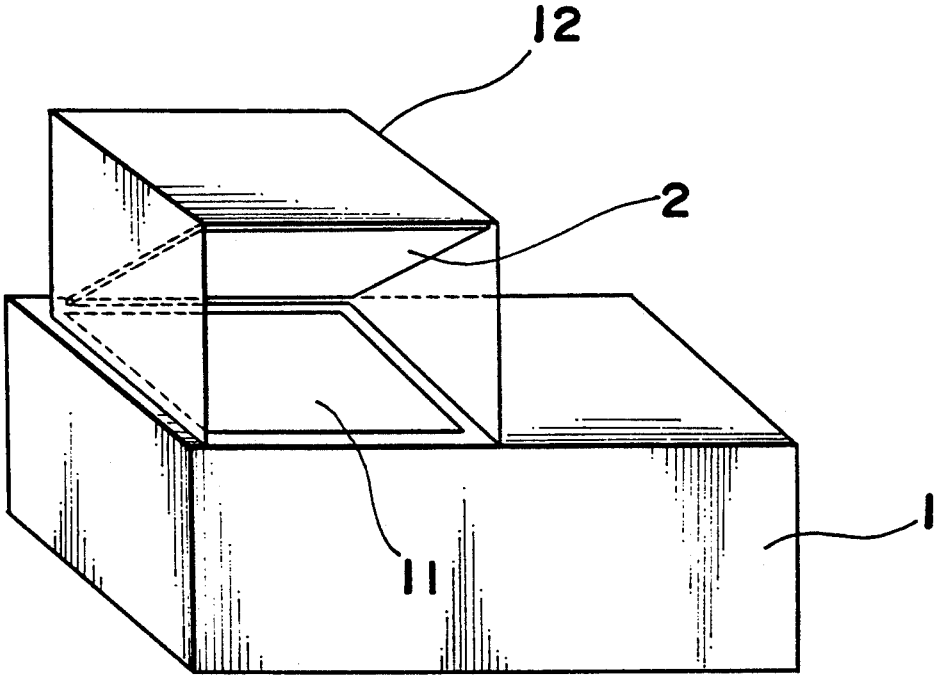
FIG. 8 is a perspective view of a display unit of the display apparatus of FIG. 6.

FIG. 8 shows the display unit 1 in more detail. The half mirror 2 is enclosed by a mirror housing 12. The operator does not view a display window 11 directly but views an image reflected by the half mirror 2.

Figure 9:
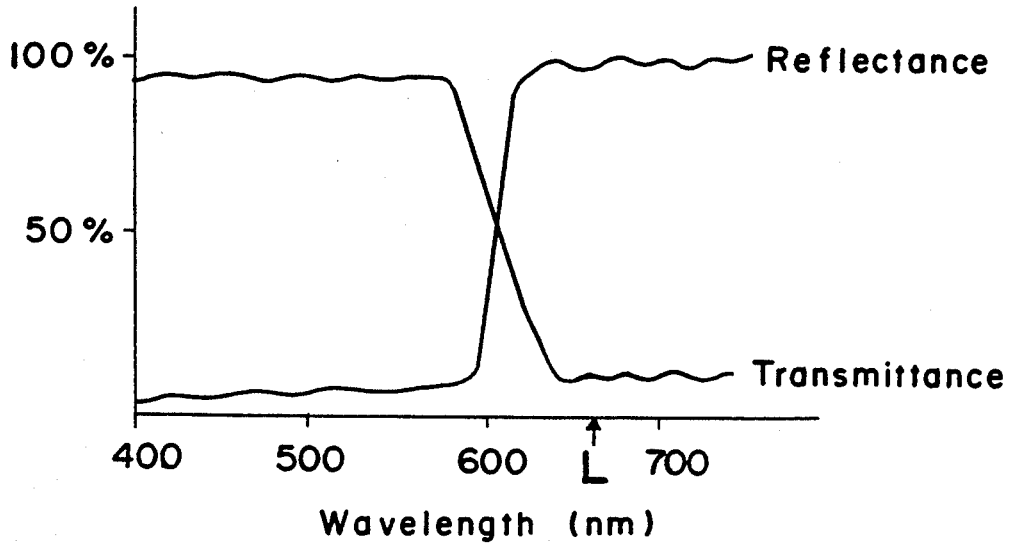
FIG. 9 is a graph showing optical characteristics of a half mirror employed in the display apparatus of FIG. 6.

FIG. 9 shows optical characteristics of the half mirror 2. It should be noted that an essential feature of the present invention is the optical characteristics of the half mirror 2. In FIG. 9, a wavelength L of about 660 nm is a light emitting wavelength of red light emitted by LEDs employed in the display apparatus K1. Namely, according to the optical characteristics shown in FIG. 9, red light portion including the wavelength L or more is reflected by the half mirror 2, while green light and blue light having wavelengths shorter than the wavelength L are transmitted through the half mirror 2.

Figure 10:
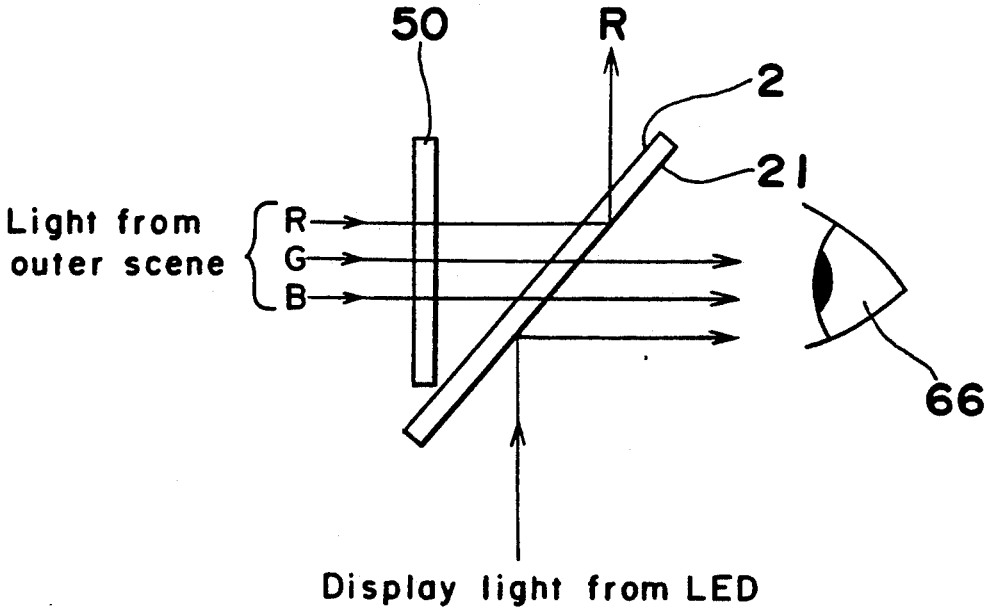
FIG. 10 is a view explanatory of reflection and transmission of light performed by the half mirror of FIG. 9.

Therefore, as shown in FIG. 10, display light from an LED array 61 (FIG. 13) is reflected by an interference layer 21 of the half mirror 2 so as to proceed to an eye 66 of the operator. Meanwhile, red component in light from an outer scene is reflected by the interference layer 21, while other components (magenta) than the red component are transmitted through the half mirror 2 so as to proceed to the eye 66 of the operator. Since the operator can simultaneously view the displayed picture and the outer scene with his one eye, the operator can depress a keyboard of the computer while viewing the displayed picture, or view the displayed picture and a meter simultaneously or manipulate a switch lever while viewing the displayed picture.

Meanwhile, as shown in FIG. 10, light from the outer scene passes through a filter 50 so as to be incident upon the half mirror 2. In the case where the display apparatus K1 is used at a bright place, quantity of display light of the LEDs is smaller than that of the outer scene and thus, such a case may happen that it becomes difficult to view display of the LEDs. The filter 50 is provided for eliminating such case. The filter 50 for transmitting therethrough an optimum quantity of light is selected in accordance with quantity of external light. To this end, several methods may be employed. In the simplest method, a plurality of filters are prepared beforehand such that one best suited to a specific service condition can be selected from the filters. In another method, the filter 50 is made of material for automatically adjusting, in accordance with quantity of external light, quantity of light to be transmitted through the filter 50, for example, photochromic glass.

Figure 2:
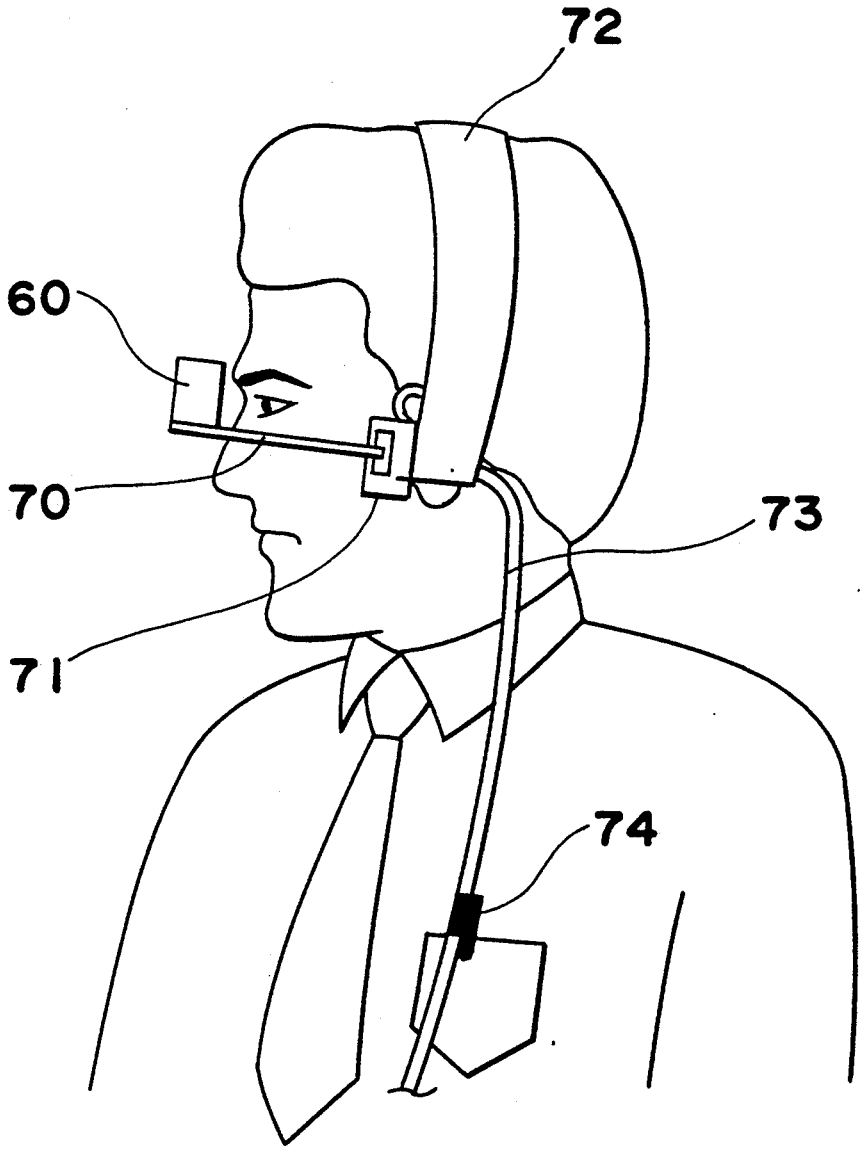
Fig. 2 PRIOR ART
FIG. 2 is a view showing that an operator puts on the prior art display apparatus of FIG. 1 (already referred to)
Figure 3:
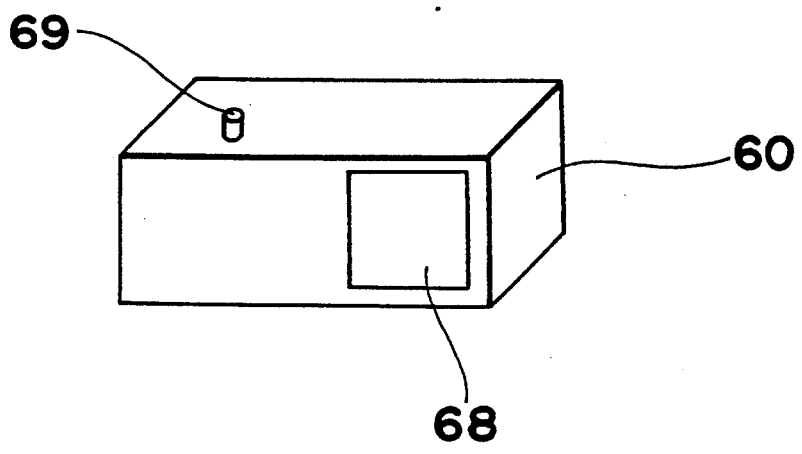
Fig. 3 PRIOR ART
FIG. 3 is a perspective view of the display unit of FIG. 1 (already referred to)
Figure 4:
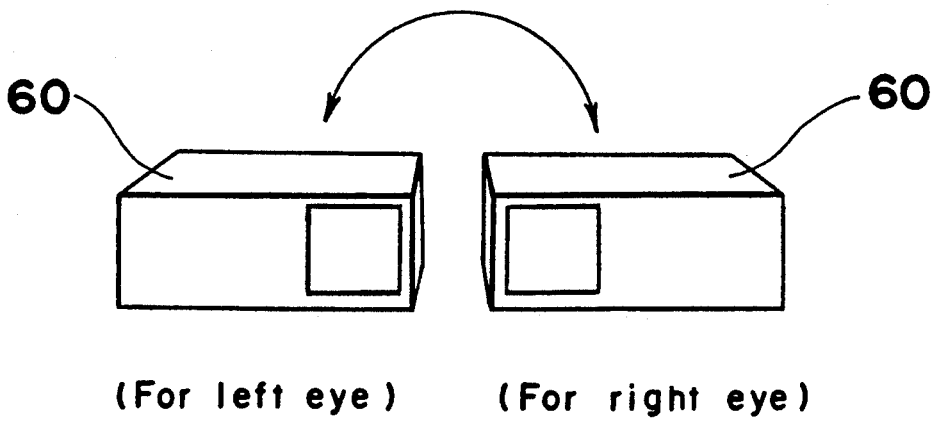
Fig. 4 PRIOR ART
FIG. 4 is a view explanatory of changeover of the display unit of FIG. 1 to right and left eyes of the operator (already referred to)

Experiments conducted by the present inventors have revealed that the display apparatus K1 or K1' of the present invention is fitted for the eye of the operator far better than the prior art display apparatus of FIG. 2. This seems to be because the comparatively large display unit 1 is not placed in front of the eye of the operator but only the smaller mirror housing 12 of FIG. 8 is placed in front of the eye of the operator. Furthermore, the experiments have shown that since the displayed picture can be seen in the bright external light, fatigue of the eye of the operator is lessened. It was found by the present inventors that it is desirable that the half mirror 2 and the filter 50 be provided not only at one eye for viewing the displayed picture but also at the other eye to provide a uniform background in order to lessen fatigue of the eyes of the operator. It is not necessary to project the displayed picture into the second eye.

As is clear from the foregoing, in the display apparatus according to the first embodiment of the present invention, the half mirror for reflecting light having wavelengths that include the light emitting wavelength of the LED array but transmitting therethrough visible light having other wavelengths than the light emitting wavelength are provided so as to not only transmit therethrough visible light from the outer scene but reflect light proceeding from the LED array through the vibrating mirror such that the two-dimensional image having the outer scene as its background is obtained. Therefore, in accordance with the present invention, since the image formed by light having the light emitting wavelength of the LED array, for example, red light can be seen in the background in which the light having the light emitting wavelength is removed from the outer scene, for example, the background formed by the bluish scene having the red component of the light removed therefrom, the operator can manipulate switches, etc. in front of the display unit while viewing the displayed picture and fatigue of eyes of the operator is lessened.

It is needless to say that since the image is inverted by the vibrating mirror in the case where the half mirror referred to above is employed, means for changing sequence or timing of application of voltage signals to the LED array is provided in the display apparatus.

Figure 11:
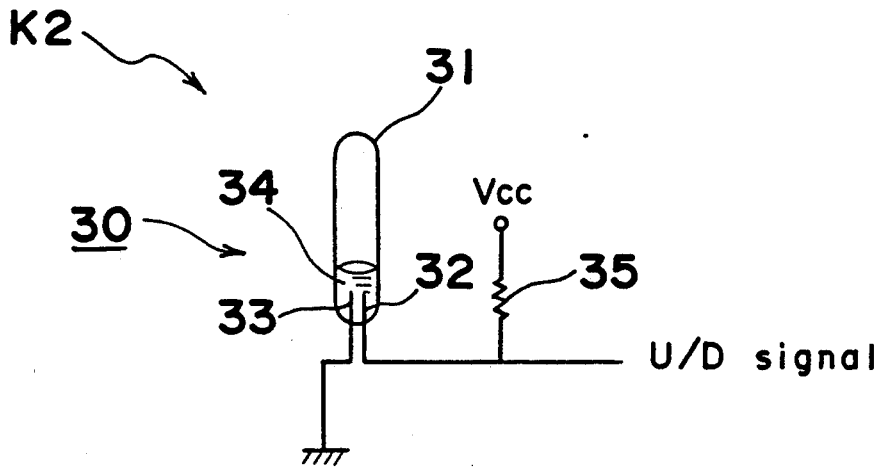
FIG. 11 is a view showing a gravity sensor employed in a display apparatus according to a second embodiment of the present invention.

Referring further to FIG. 11, there is shown a gravity sensor 30 employed in a display apparatus K2 according to a second embodiment of the present invention. The gravity sensor 30 is provided for indicating vertical orientation of the display apparatus K2 and includes a hermetically sealed vessel 31 made of glass, etc. Two electrodes 32 and 33 extend through one end of the vessel 31 and electrically conductive liquid 34 such as mercury, etc. in an amount sufficient to dip the electrodes 32 and 33 is put in the vessel 31. The electrode 33 is grounded. Meanwhile, a voltage Vcc of +5 V is applied to the electrode 32 via a resistor 35 such that a signal indicative of vertical orientation of the display apparatus K2 is outputted as an upside down signal (U/D signal) produced by voltage of the electrode 32. Namely, when the display apparatus K2 has been oriented upwardly, the liquid 34 is filled between the electrodes 32 and 33 as shown in FIG. 11, so that electric current flows through the resistor 35 and thus, the U/D signal is set to LOW level (0 V). On the other hand, when vertical orientation of the display apparatus K2 has been reversed, the liquid 34 moves in the direction away from the electrodes 32 and 33 by its gravity in the vessel 31 so as not to fill between the electrodes 32 and 33, so that electric current does not flow through the resistor 35 and thus, the U/D signal is set to HIGH level (5 V). Since other constructions of the display apparatus K2 are similar to those of the display apparatus K1, description thereof is abbreviated for the sake of brevity.

Figure 13:
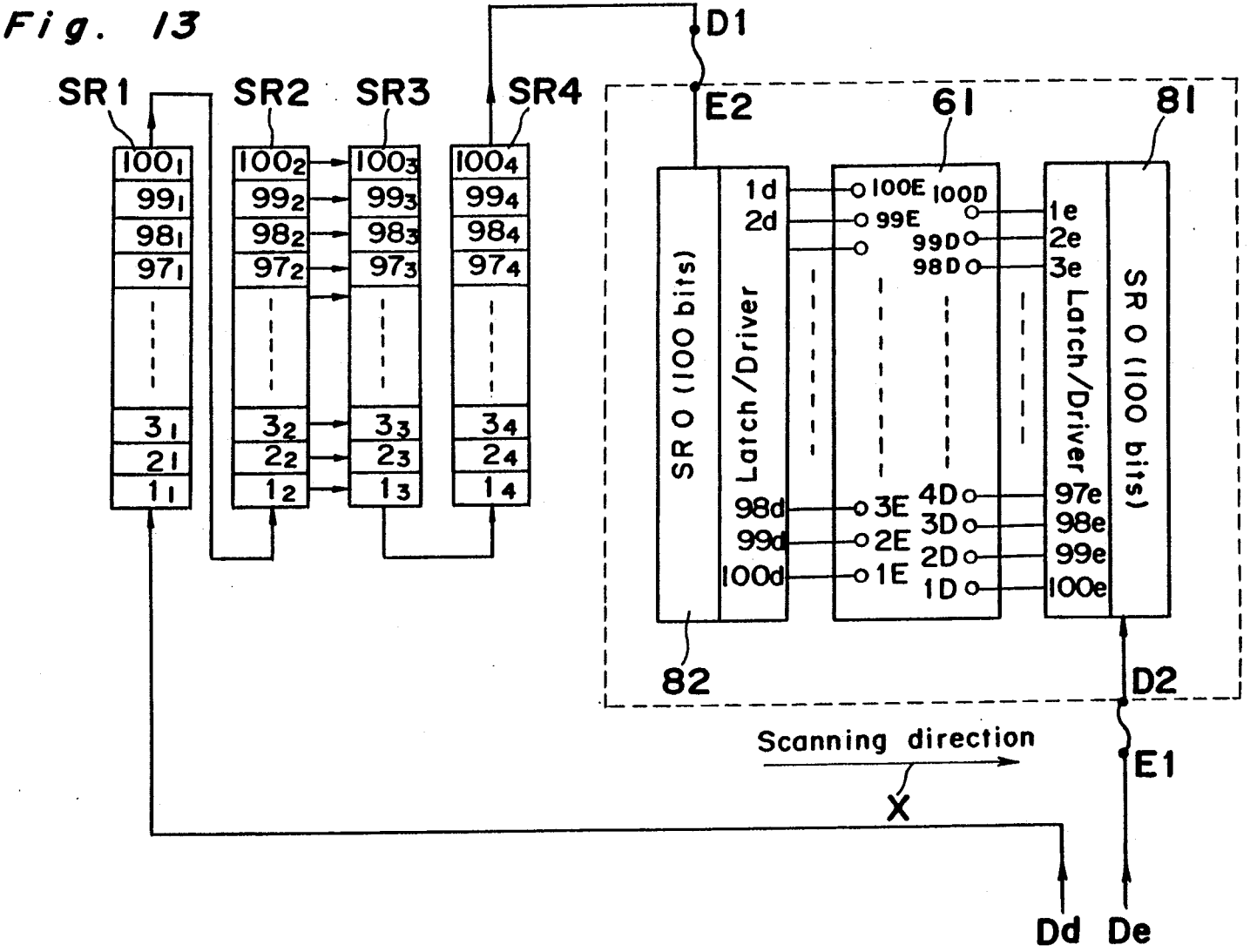
FIG. 13 is a view explanatory of changeover of LED drivers employed in the display apparatuses of FIG. 11.

Meanwhile, LED drivers of the display apparatus K2 have a circuit configuration similar to that of the prior art LED drivers of FIG. 5 so as to change over vertical orientation of the picture of the display apparatus K2 through changeover of an image signal circuit in response to the U/D signal from the gravity sensor 30 as shown in FIG. 13 to be described later.

Figure 12:
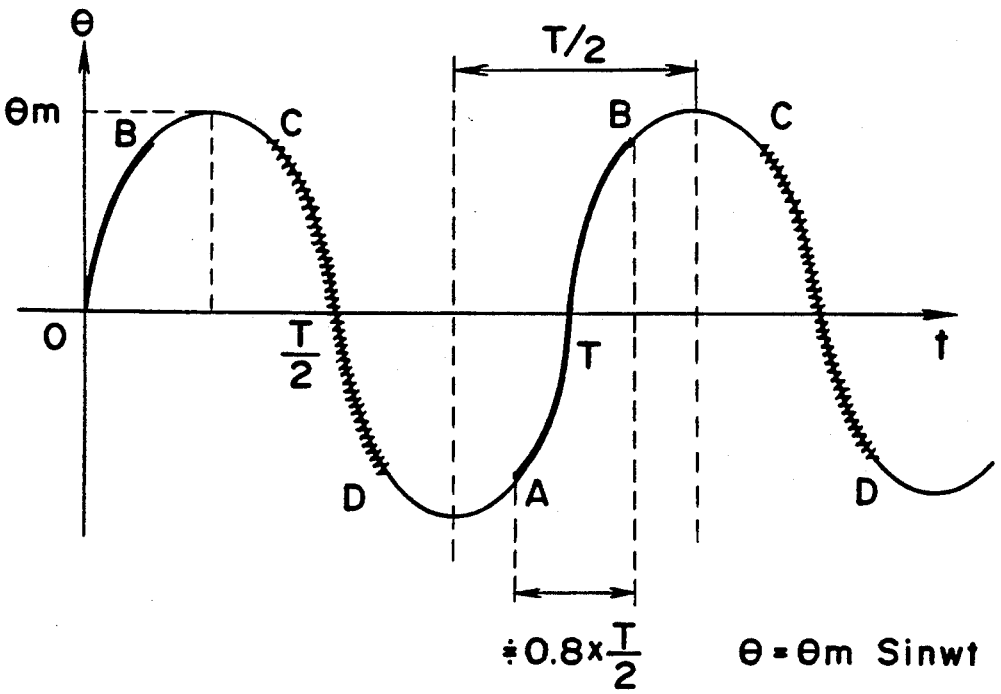
FIG. 12 is a graph showing relation between time and vibrational angle of a vibrating mirror of the display apparatus of FIG. 11

FIG. 12 shows vibrations of the vibrating mirror of the display apparatus K2. In FIG. 12, the abscissa represents time (t) and the ordinate represents angle ($\theta$) of vibrations of the vibrating mirror. As shown in FIG. 12, the vibrating mirror makes a motion of sinusoidal wave expressed by the following equation.

$$\theta = \theta m \ \mathrm{Sin}\omega t$$

Figure 5:
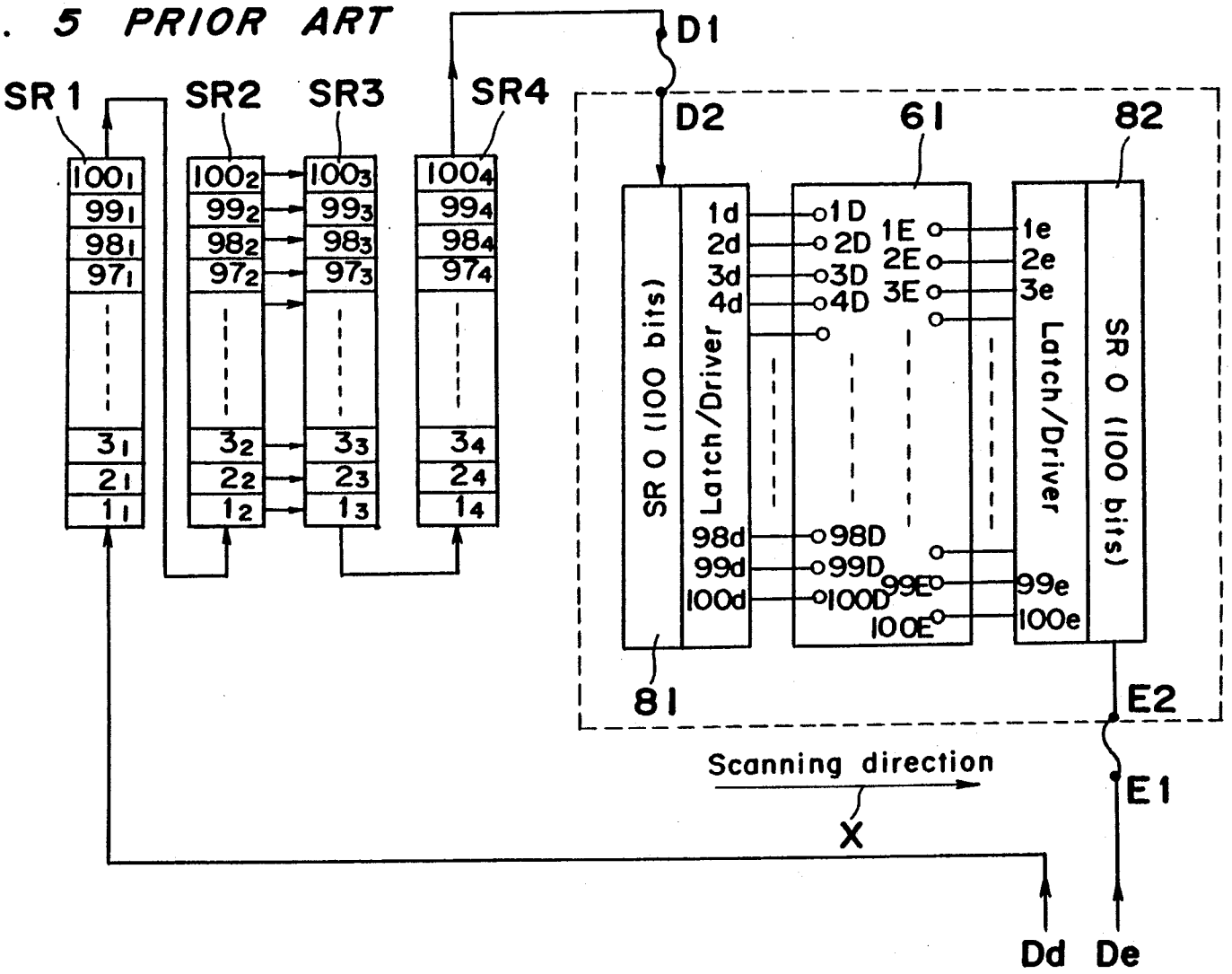
Fig. 5 PRIOR ART
FIG. 5 is a block diagram of LED drivers of the prior art display apparatus of FIG. 1 (already referred to)

Supposing that character T denotes a period of vibrations of the vibrating mirror, scanning direction indicated by the arrow X in FIG. 5 represents scanning direction in the case where the LED array 61 has been turned on at a rise portion between the points A and B in the wave form. The rise portion occupies about $0.8 \times T/2$. On the contrary, in the case where the LED array 61 has been turned on at a fall portion between the points C and D in the wave form, the scanning direction is opposite to the direction of the arrow X.

In the case where the display apparatus is oriented upwardly, namely, when the gravity sensor 30 outputs the LOW U/D signal, the LED array 61 is turned on at the rise portion between the points A and B. Meanwhile, in the case where vertical orientation of the display apparatus K2 has been reversed, namely when the gravity sensor 30 outputs the HIGH U/D signal, the LED array 61 is turned on at the fall portion between the points C and D. This changeover can be performed quite easily by merely changing, by about T/2, timing of turning on of the LED array 61. However, if no measure is taken, not only the displayed picture is subjected to mirror inversion but sequence of turning on of the LEDs 1D, 2D,—100D of the odd rows and the LEDs 1E, 2E, —100E of the even rows in the zigzag LED array 61 is not corrected at all.

Thus, in order to prevent the displayed picture from being subjected to mirror inversion and correct sequence of turning on of the LEDs 1D, 2D,—100D of the odd rows and the LEDs 1E, 2E,—100E of the even rows, input of image signals to LED drivers 81 and 82 for driving the LED array 61 is changed from that of FIG. 5 as shown in FIG. 13. Namely, from a state shown in FIG. 5, a terminal E2 is disconnected from a terminal E1 and is connected to a terminal D1, while a terminal D2 is disconnected from the terminal D1 and is connected to the terminal E1 as shown in FIG. 13. In this case, image signals Dd and De are exactly identical with those of FIG. 5. By adopting the above described circuit configuration, the LEDs 100E, 99E,—2E and 1E of FIG. 13 are, respectively, driven by components 1*d*, 2*d*,—99*d* and 100*d* of the image signal Dd for driving the LED 1D, 2D,—99D and 100D of FIG. 5, respectively, while the LEDs 100D, 99D,—2D and 1D of FIG. 13 are, respectively, driven by components 1*e*, 2*e*,—99*e* and 100*e* of the image signal De for driving the LEDs 1E, 2E,—99E and 100E of FIG. 5, respectively, whereby an image free from mirror inversion, in which sequence of turning on of the LEDs of the odd rows and the LEDs of the even rows has been corrected, can be obtained.

Thus, in the display apparatus K2, it becomes possible to easily change over vertical orientation of the picture by, in response to the U/D signal from the gravity sensor 30, merely not only changing timing of turning on of the LED array 61 but changing over input of the image signals to the LED drivers 81 and 82.

As will be seen from the description given so far, in the display apparatus according to the second embodiment of the present invention, the vertical orientation indicating means indicates whether the display apparatus is oriented upwardly or downwardly such that, in response to the signal from the vertical orientation indicating means indicative of whether the display apparatus is oriented upwardly or downwardly, the means for driving the LED array not only turns on the LED array at the rise region or the fall region of the sinusoidal wave-for driving the vibrating mirror but also sets sequence of turning on of the LED array in the forward direction or in the reverse direction. Consequently, in the second embodiment of the present invention, vertical orientation of the picture can be changed by the simple circuit based on whether the display apparatus is oriented upwardly or downwardly.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. In a heads-up display apparatus in which light outputted from an LED display arranged in a column is reflected by a vibrating mirror driven in a sinusoidal wave such that a two-dimensional image is obtained, the improvement comprising:

first means for indicating whether said display is oriented upwardly or downwardly; and LED driving means for driving said LED array, said driving means being responsive to a signal from said first means indicative of whether said display apparatus is oriented upwardly or downwardly such that:

if said first means indicates that the display apparatus is oriented upwardly, said LED driving means drives the LED array at a rise region of the sinusoidal wave while turning on said LED array in a forward direction; and if said first means indicates that the display apparatus is oriented downwardly, said LED driving means drives the LED array at a fall region of the sinusoidal wave while turning on said LED array in a reverse direction.

2. A display apparatus as claimed in claim 1, wherein said first means is formed by a gravity sensor.

3. A display apparatus as claimed in claim 2, wherein said gravity sensor includes a hermetically sealed vessel, a pair of electrodes extending through one end of said vessel and electrically conductive liquid put in said vessel.

4. A display apparatus as claimed in claim 3, wherein said liquid is mercury.

5. In a heads-up display apparatus in which light outputted from an LED display arranged in a column is reflected by a vibrating mirror such that a two-dimensional image is obtained, the improvement comprising:

a first half mirror which reflects light from roughly half the visible spectrum, wherein the wavelengths of light reflected include the wavelength of light emitted by said LED array and transmits therethrough visible light having other wavelengths;

said first half mirror being so disposed as to not only transmit therethrough the visible light from outside but also reflect the light proceeding from said LED array via said vibrating mirror such that the two-dimensional image is viewed against a background of those elements of an outer scene containing spectral components transmitted by said first half mirror;

wherein the vibrating mirror is driven by a periodic signal and wherein the apparatus further comprises:

first means for indicating whether the display is oriented upwardly or downwardly; and LED driving means for driving said LED array, said driving means being responsive to a signal from said first means indicative of whether said display apparatus is oriented upwardly or downwardly such that:

if said first means indicates that the display apparatus is oriented upwardly, said LED driving means drives the LED array during a first portion of the periodic signal while turning on said LED array in a forward direction; and if said first means indicates that the display apparatus is oriented downwardly said LED driving means drives the LED array during a second portion of the periodic signal while turning on said LED array in a reverse direction.

6. A heads-up display apparatus, comprising:

a plurality of LED devices arranged in a column;

LED driving means for driving the LED devices;

a vibrating mirror placed so as to reflect light generated by the LED devices, said mirror driven by a periodic signal such that a two-dimensional image is obtained;

a first half mirror which reflects light from roughly half the visible spectrum, including the wavelength of light emitted by the LED devices, and transmits therethrough visible light having other wavelengths; and first means for indicating whether the display apparatus is oriented upwardly or downwardly;

said driving means being responsive to a signal from said first means indicative of whether the display apparatus is oriented upwardly or downwardly such that:

if said first means indicates that the display apparatus is oriented upwardly, said LED driving means drives the column of LED devices during a first portion of the periodic signal while turning on said LED array in a forward direction; and if said first means indicates that the display apparatus is oriented downwardly, said LED driving means drives the column of LED devices during a second portion of the periodic signal while turning on said LED array in a reverse direction; and said first half mirror being disposed so as to not only transmit therethrough the visible light from outside but also reflect the light reflected from the vibrating mirror such that the two-dimensional image is viewed against a background of those elements of an outer scene containing spectral components transmitted by said first half mirror.

* * * * *